US006565031B2

(12) United States Patent
Haak

(10) Patent No.: US 6,565,031 B2
(45) Date of Patent: May 20, 2003

(54) COIL-LAYING DEVICE

(75) Inventor: Peter Haak, Freudenberg (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 72 days.

(21) Appl. No.: 09/945,149

(22) Filed: Aug. 31, 2001

(65) Prior Publication Data

US 2002/0047064 A1 Apr. 25, 2002

(30) Foreign Application Priority Data

Sep. 1, 2000 (DE) ..... 100 43 572

(51) Int. Cl.[7] ..... B21C 47/14; B65H 54/00
(52) U.S. Cl. ..... 242/361
(58) Field of Search ..... 242/361, 361.1, 242/361.2, 361.3, 361.4, 361.5; 72/66, 135

(56) References Cited

U.S. PATENT DOCUMENTS 3,469,429 A * 9/1969 Dopper et al. ..... 72/66
5,312,065 A * 5/1994 Shore et al. ..... 242/361
5,897,071 A * 4/1999 Hauck et al. ..... 242/361

FOREIGN PATENT DOCUMENTS

| | | |
|---|---|---|
| DE | 1 291 716 | 4/1969 |
| EP | 0 554 976 | 8/1993 |
| GB | 1 175 402 | 12/1969 |

* cited by examiner

*Primary Examiner*—John M. Jillions
(74) *Attorney, Agent, or Firm*—Herbert Dubno; Andrew Wilford

(57) ABSTRACT

A coil-laying device has a body having a generally cylindrical outer surface centered on and rotatable about an axis and wall structure forming on the surface a radially outwardly open groove having an intake end, a center, and an output end. The groove has an axial dimension that decreases from the intake end to the center and that increases from the center to the output end. The groove has an angular dimension of about 360° and the center is located about 250° from the output end, so that the center is spaced between 0° and 110° from the intake end. Furthermore the groove is defined between walls that taper together between the intake end and the center at a predetermined angle and that diverge from the center to the output end at a larger angle.

4 Claims, 1 Drawing Sheet

COIL-LAYING DEVICE

FIELD OF THE INVENTION

The present invention relates to an apparatus for coiling wire. More particularly this invention concerns a coil-laying device for such an apparatus.

BACKGROUND OF THE INVENTION

Wire or rod (hereinafter termed "wire" only) is formed at high speed in a rolling or drawing mill and is delivered in straight condition to a coiler that forms it into a succession of large-diameter turns that it deposits on a surface, normally a conveyor of some type. Thence the coiled wire is moved through subsequent treatment steps such as heat treatment, descaling, pickling, or simply cooling. It is critical that the wire be deposited in uniformly shaped and spaced coils so that the subsequent treatment stage is effective.

The typical coiling system has a head fitted with a so-called laying tube twisted in three dimensions and having an intake upstream end opening axially in line with an axis about which the tube is rotated and a downstream output end which opens at a location radially offset from the axis and is directed generally tangentially. The straight wire is fed into the upstream end of the laying tube as it is rotated about its axis so that as the wire passes through the tube it is bent into an arcuate shape.

On exiting the laying tube the wire typically enters a helicoidal groove of a coil-laying device as described in British patent 1,175,402 and German patent document 1,291,716 of Bollig that rotates jointly with the head. This coil-laying device is a generally cylindrical structure formed with a helical or helicoidal passage through which the coiled wire is lead to set in the wire the desired shape. On leaving the coil-laying device the wire falls in a neat succession of turns on a belt or chain conveyor.

In EP 0,554,976 of Shore a system is shown where the wire is shaped on a drum having a helical and radially outwardly open groove formed between turns of a helical and radially outwardly projecting ridge or wall. This system is advantageous in that it allows the wire to be cooled relatively easily, and is particularly easy to load and service.

Practice has shown that the ability to influence the cross section and surface quality of the wire drawn through the grooves of the coiling device is very limited and in addition when wire diameter changes the device has to be replaced with one having an appropriately dimensioned groove. This is fairly expensive and difficult and entails considerable down time for the machine.

OBJECTS OF THE INVENTION

It is therefore an object of the present invention to provide an improved coiling device.

Another object is the provision of such an improved coiling device which overcomes the above-given disadvantages, that is which is of simple construction and that serves for better guiding the wire, especially at its leading and trailing ends.

SUMMARY OF THE INVENTION

A coil-laying device has a body having a generally cylindrical outer surface centered on and rotatable about an axis and wall structure forming on the surface a radially outwardly open groove having an intake end, a center, and an output end. The groove has according to the invention an axial dimension that decreases from the intake end to the center and that increases from the center to the output end.

The groove has an angular dimension of about 360° and the center is located about 250° from the output end, so that the center is spaced between 0° and 110° from the intake end.

Furthermore according to the invention the groove is defined between walls that taper together between the intake end and the center at a predetermined angle and that diverge from the center to the output end at a larger angle.

It has been found that such a laying device can be used without difficulty on wire of different caliber. Furthermore whipping of the trailing wire end is largely eliminated by the tapering/diverging shape of the groove. The intake end, that flares upstream, is ideally dimensioned to receive the starting end of a new wire so that alignment problems with the outlet of the laying tube are largely eliminated.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
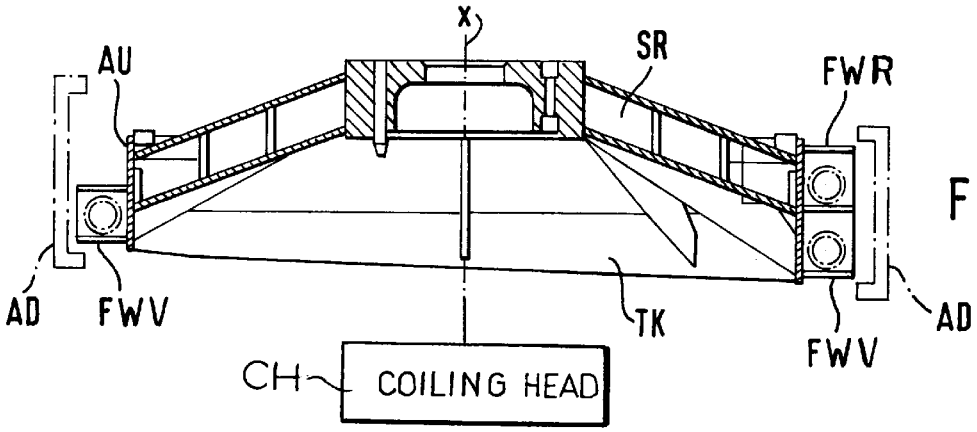
FIG. 1 is an axial section through a coiling device according to the invention.
Figure 2:
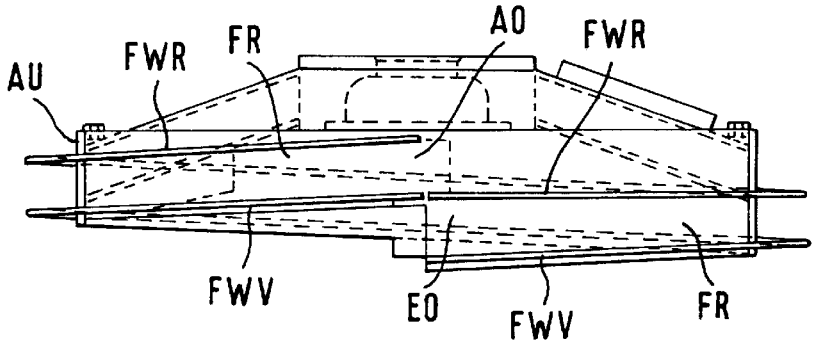
FIGS. 2 and 3 are side views of the device.
Figure 3:
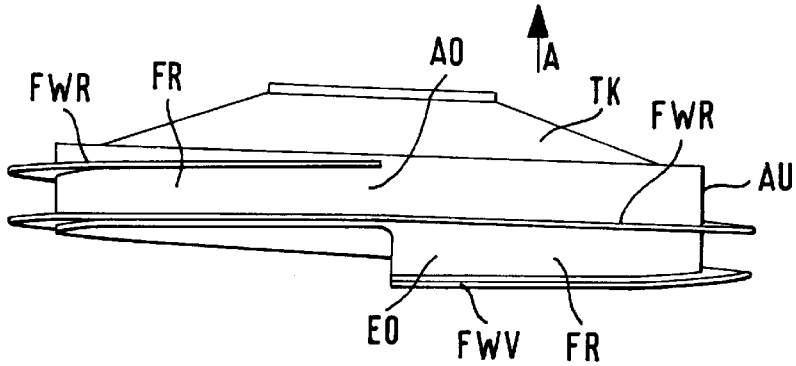

As seen in FIGS. 1 through 3 a coiling device TK rotatable about and centered on an axis x has a frustoconical frame SR supporting a cylindrical inner wall AU also centered on the axis x. A radially projecting ridge or wall FWR extending through about 360° from the wall AU and another such ridge or wall FWV that extends through another 360° from a downstream end of the wall FWR form a radially outwardly open guide groove FR of helicoidal shape that is closed radially outward by a wall AD and that extends through 360°. The walls FWV and FWR form an intake EO and an output AO.

Figure 4:
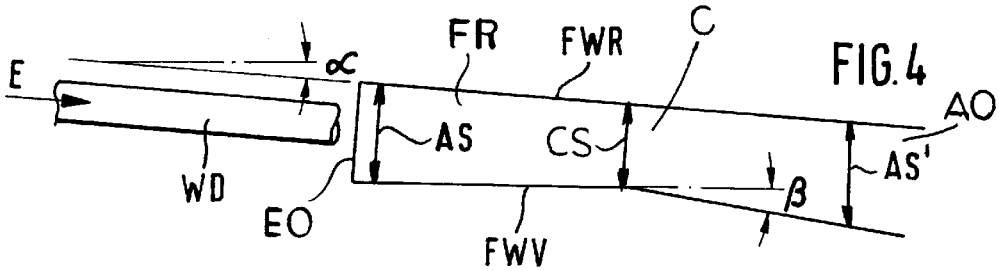
FIG. 4 is a schematic view illustrating the invention.

As shown in FIG. 4, during normal use a wire WD is introduced by a coiling head CH such as described in U.S. Pat. No. 5,897,071 in a direction E into the intake end EO, passes helicoidally through 360° along the groove FR (here shown straight for clarity of view), and exits from the outlet end AO, also traveling generally axially as shown by arrow A (FIG. 3). This is generally standard.

According to the invention the walls FWR and FWV form at the intake EO an acute angle $\alpha$ with each other so as to decrease their axial spacing from a dimension AS to a smaller axial dimension CS near a center C of the groove FR, in effect tapering in the direction of movement of the wire WD through the groove FR. From the center location the groove width again flares to a slightly larger dimension AS' at the outlet end AO, the walls FWR and FWV forming an angle $\beta$ slightly larger than the angle $\alpha$ and diverging from each other.

Here the angular dimension from the intake end EO to the center C is about 110° and the angular dimension from the center C to the output end AO is 250°. Thus the term "center" is being used roughly, not to indicate the exact center of the groove FR.

This construction is particularly effective in damping movement in the ends of the wire WD. The decreasing width of the groove FR prevents oscillation and whipping in the wire, and suppresses these movements so that the wire will smoothly pass through and leave the device TK.

I claim:

1. A coil-laying device comprising:

a body having a generally cylindrical outer surface centered on and rotatable about an axis;

wall structure forming on the surface a radially outwardly open groove having an intake end, a center, and an output end, the groove having an axial dimension that decreases from the intake end to the center and that increases from the center to the output end.

2. The coil-laying device defined in claim 1 wherein the groove has an angular dimension of about 360° and the center is located about 250° from the output end.

3. The coil-laying device defined in claim 1 wherein the groove has an angular dimension of about 360° and the center is located at up to 110° from the intake end.

4. The coil-laying device defined in claim 1 wherein the groove is defined between walls that taper together between the intake end and the center at a predetermined angle and that diverge from the center to the output end at a larger angle.

* * * * *